US006718899B2

(12) United States Patent
Pollack

(10) Patent No.: US 6,718,899 B2
(45) Date of Patent: Apr. 13, 2004

(54) METHOD FOR INSTALLING A NUMBER OF RISERS OR TENDONS AND VESSEL FOR CARRYING OUT SAID METHOD

(75) Inventor: Jack Pollack, Monaco (MC)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 10/298,952

(22) Filed: Nov. 19, 2002

(65) Prior Publication Data

US 2003/0066470 A1 Apr. 10, 2003

Related U.S. Application Data

(62) Division of application No. 09/936,750, filed as application No. PCT/EP00/02363 on Mar. 16, 2000, now Pat. No. 6,499,418.

(30) Foreign Application Priority Data

Mar. 16, 1999 (EP) ..... 99200823

(51) Int. Cl.[7] ..... B63B 21/00

(52) U.S. Cl. ..... 114/230.1; 114/264; 405/223.1; 166/352

(58) Field of Search ..... 114/230.1, 264, 114/265; 405/223.1; 166/352

(56) References Cited

U.S. PATENT DOCUMENTS

| | | | |
|---|---|---|---|
| 3,681,928 | A | 8/1972 | Vincken et al. |
| 4,272,059 | A | 6/1981 | Noerager et al. |
| 4,423,983 | A | 1/1984 | Dadiras et al. |
| 4,487,150 | A | 12/1984 | Shanks |
| 4,657,439 | A | 4/1987 | Petersen |
| 5,147,148 | A | 9/1992 | White et al. |

FOREIGN PATENT DOCUMENTS

| | | |
|---|---|---|
| GB | 2 109 036 | 5/1983 |
| WO | WO 99/31345 | 6/1999 |

*Primary Examiner*—Stephen Avila
(74) *Attorney, Agent, or Firm*—Young & Thompson

(57) ABSTRACT

A method of connecting two or more elongate connection members (105) between the seabed and a floating vessel (106) carrying a connector (102) which is suspended from the vessel by at least two spaced apart suspension members for relative displacement of the connector with respect to the vessel, at least one suspension member being connected to tensioning elements (109, 109') for exerting an upward force on the connector. The method comprises the steps of: a) attaching one or more connection members to the connector, b) increasing the tensioning force of the tensioning elements, or vice versa, and c) repeating steps a and b until the connection members are installed between the vessel and the seabed.

2 Claims, 11 Drawing Sheets

METHOD FOR INSTALLING A NUMBER OF RISERS OR TENDONS AND VESSEL FOR CARRYING OUT SAID METHOD

This application is a division of Application No. 09/936,750, filed on Sept. 17, 2001 now U.S. Pat. No. 6,499,418. Application No. 09/936,750 is the national phase of PCT International Application No. PCT/EP00//02363 filed on Mar. 16, 2000 under 35 U.S.C. §371. The entire contents of each of the above-identified applications are hereby incorporated by reference.

BACKGROUD OF INVENTION

The invention relates to a method of connecting two or more elongate connection members, such as risers or tendons, between the seabed and a floating vessel. The invention also relates to a vessel for carrying out this method and to a vessel carrying a connector suspended from the vessel by at least two spaced apart suspension members for relative displacement of the connector with respect to the vessel, one or more elongate connection members, such as risers or tendons, being attached with one end to the connector and with their other end to the seabed.

From U.S. Pat. No. 4,272,059 a riser tensioning system is known wherein a riser, such as a drilling riser, is at its upper end provided with a tension ring which is connected via cables to sheaves on the drilling vessel. The sheaves are mounted on the free end of piston rods of hydraulic cylinders, the second end of the cables is being attached to the vessel. Upon heave, roll or pitch of the vessel the tensional forces on the riser are maintained generally constant by movement of the piston rods against the hydraulic pressure in the cylinders. This system has as a disadvantage that it carries only a single riser and that tensional forces exerted on the riser will vary with the buoyancy of the vessel. In order to obtain a relatively large stroke of the cylinders, these cylinders should be relatively long and therefore take up a lot of space, which in view of the moving nature of the cylinders cannot be effectively used. Furthermore, the hydraulic system is relatively complex.

From U.S. Pat. No. 3,681,928 a barge supporting a drilling rig is known, in which a platform is movably suspended from two mounting arms above deck level of the barge. The platform is connected to the seabed via two parallel tendons which pass through openings in the platform and through a central well in the barge. By this construction the platform remains in a horizontal position and at a constant height above the seabed when the vessel moves vertically due to wave motion. Under the influence of the dependant counterweights, the tendons are kept taut.

SUMMARY OF THE INVENTION

It is an object of the present invention to provide a method and a vessel for attaching multiple risers or tendons to the seabed and to the vessel. It is especially an object of the present invention to provide a method of drilling a subsea hydrocarbon well and attaching multiple risers with one end to the wellhead and with their other end to the vessel. Thereto the method is characterised in that it comprises the steps of:

a. attaching one or more connection-members to the connector, b. increasing the tensioning force on the tensioning means, or vice versa, and c. repeating steps a and b until the connection members are installed between the vessel and the seabed.

The present invention is based on the insight that a constant tensioning force can be easily maintained on the tendons or risers when they are being connected to the wellhead one after the other, by a stepwise increase of the tensioning force of the tensioning means. Each time after a drilling operation, one or more additional risers are attached to the connector. In case of hydraulic tensioning means, it is envisaged that the oil pressure in the hydraulic system or the air pressure in case of a pneumatic system, is stepwise increased when the number of risers and tendons attached to the connector increases. In case of the connector being suspended from a cable or rod, the tensioning force can be increased in a stepwise manner by adding extra tensioning weights or buoyancy members to the second end of the cable or rod. The increase in the tensioning force according to step b above can be carried out either prior to or after connection of additional connection members to the connector.

The method of the present invention of stepwise increase of the tensioning force is especially suitable for drilling methods in deep water. In this case the risers may have a length of 1000 meters or more and may have a weight of between 40 and 60 tons in submerged conditions. Each time one or more risers are installed, the force exerted by the connector of the present invention is increased a little over 40–60 tons, or a multiplicity thereof corresponding to the number of risers or tendons that are added, such that a substantially constant tension is maintained in the risers or tendons at all times. A further advantage is that, depending on the prevailing current, the tensioning force can be varied to compensate for the current factor and prevent the risers from buckling.

In one embodiment, the connector may be formed by a deck structure suspended from two or more oppositely located pivoting arms, which on their free ends are provided with connection means for attaching a multiplicity of separate weight elements to the free end of the arms.

The connector may also be suspended from cables running along sheaves the free end of the cables carrying a counterweight. Additional counterweight elements may be added around the cable to be suspended from the free end to increase the tensioning force. As is used herein, the term "cable" comprises ropes, wires, chains, lines, combinations thereof and any equivalent means.

In one preferred embodiment, the cables have a first section extending vertically downward front the vessel to below water level and a second section which extends in a loop back upwards from the first section to a pulling device on the vessel, tensioning weights being comprised on the first and second cable sections. The tensioning force on the connector can be varied by varying the length of the first and second cable sections via the pulling device. When the loop is made large, the tensioning weight will be placed on the first cable section and will act completely on the connector. When the second cable section is shortened, the tensioning weight will be placed along the second cable section such that less weight is dependant from the connector via the first cable section. The tensioning weight may be comprised of clump-weights added to the cable or may be formed by the weight of the cable section itself, which may for instance be formed by a chain.

In another embodiment, the cables are guided along a cable guide means, such as a sheave, and are with one end attached to the seabed. A take-up device is connected to the cables for varying the cable length. The cable may be comprised of an anchor line such as a polyester line, the tension of which can be varied by the take-up device, which can for instance be formed by a winch. In another embodiment the cables may comprise a chain part carrying clump weights. By varying the length of the cable, the clump weights may be lifted from the seabed one after the other, such that the tensioning force on the connector is increased. The take-up device may be comprised of a winch and chain stopper assembly of the type known in the state of the art.

The varying tensioning force on the connector can in another embodiment be exerted by a buoyancy tank which is attached to the free end of cables from which the connector is suspended. The cables may be guided via a sheave to a cable guide means located below keel level, such that the upward buoyancy force acts on the cable. The buoyancy tanks may for instance exert a maximum upwards force of 600 tons each, three buoyancy tanks being attached to the connector. Pneumatic lines may be attached to the buoyancy tanks for ballasting or deballasting the tanks. In another embodiment, the position of the cable-guide means with respect to keel level of the vessel can be varied such that the tensioning force is increased or decreased.

In a further alternative embodiment, the tensioning force on the suspension members can be varied by movement of the pivot arms from which the risers or tendons are suspended, with respect to pivot points and/or by movement of a counterweight along the pivot arms. The counterweight may be moved for instance by means of a rack and pinion construction.

A vessel according to the present invention, which comprises a connector suspended from at least two spaced apart suspension members, is characterised in that a supporting deck is situated above the connector, a first section of a connection member extending from the seabed to the connector and being detachably connected to a second section of the connection member via coupling device, the second section extending to the supporting deck. Preferably the connector carries a blow-out preventor, the supporting deck carrying a drilling rig. The drill string that is attached to the drilling rig, may be disconnected from rig during high seas, when drilling is suspended. The casing is suspended from the blow-out preventor. When the relative motions between the connector and the deck are again within certain limits, the drill string can be reconnected to the drilling rig and drilling may be resumed. In this way it is not necessary to dismantle the total drill string and drilling riser, because the drill string and drilling riser can after disconnection move independently from the drilling rig. In this way drilling down time in stormy conditions is reduced compared to constructions in which the blow-out preventor is situated on the seabed and disconnection of the drilling riser is effected near the seabed, at the position of the blow-out preventor.

BRIEF DESCRIPTION OF THE DRAWINGS

Different embodiments of the method and vessel according to the present invention will be explained in detail with reference to the accompanying, non-limiting drawings. In the drawings:

FIG. 9 shows buoyancy means for exerting a tensioning force.

DETAILED DESCRIPTION OF THE PREFERRED EMBODIMENTS

Figure 1:
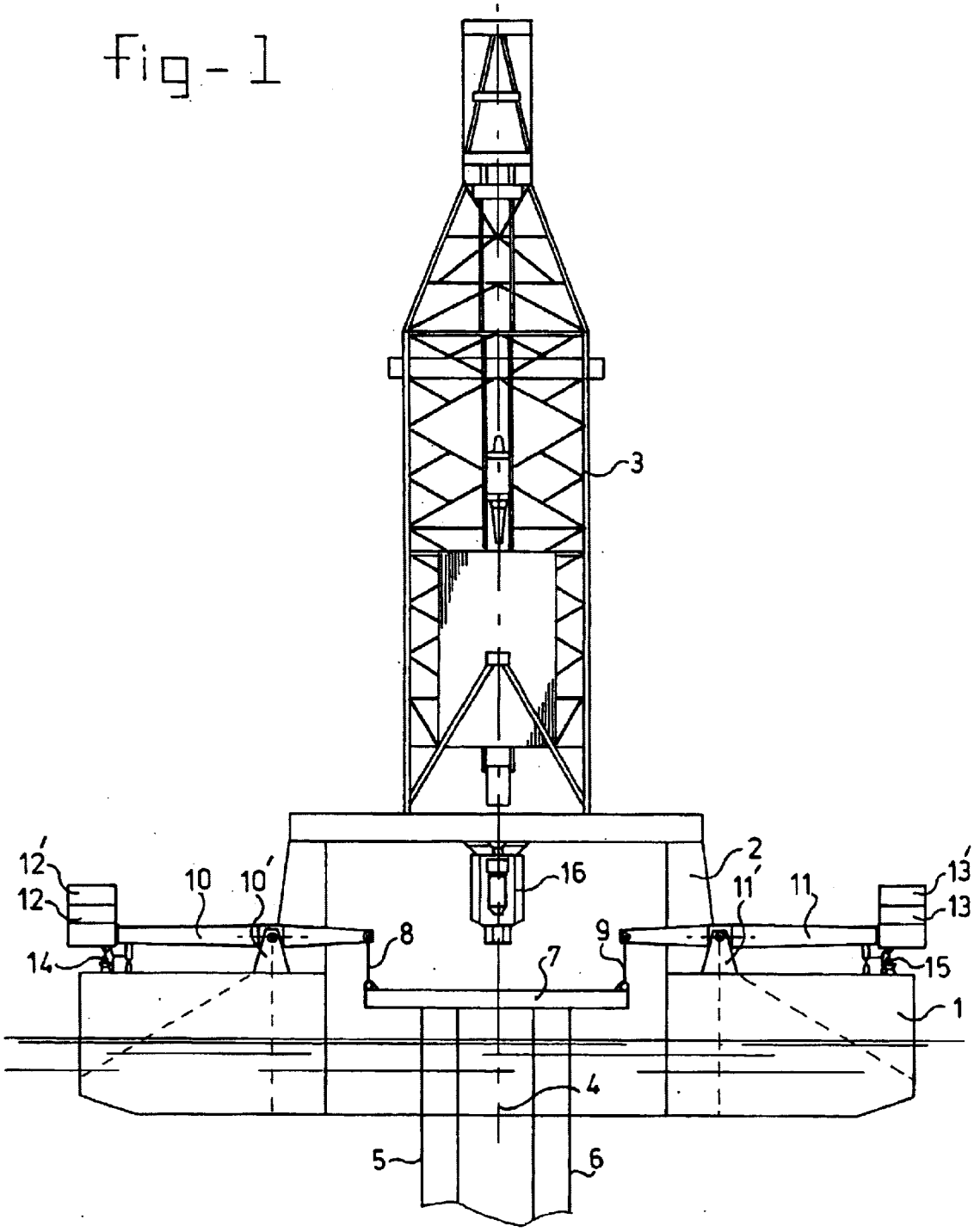
FIG. 1 shows a vessel comprising a riser tensioning deck attached to pivoting arms, to which weight elements can be added.

FIG. 1 shows a drilling barge 1 with a supporting deck 2, carrying a drilling rig 3. From the drilling rig 3, a drilling riser, schematically indicated with the dash and dot line 4, is introduced into the seabed for drilling a hydrocarbon well. The risers 5, 6 which are connected to the wellheads, are suspended from a connector, or riser tensioning deck 7. The riser tensioning deck 7 is supported from cables or rods 8, 9 connected to the free ends of pivot arms 10, 11, which are supported on pivot mountings 10', 11'. At their second end the pivot arms 10, 11 are provided with weight elements 12, 12', 13, 13'. The weight elements can be individually connected to or detached from the arms 10, 11, each time a riser is connected to or is disconnected from the deck 7. Tensioning deck 7 maintains a substantially constant tension in the risers 5, 6 during wave-induced motions of the barge 1, by pivoting movements of the arms 10, 11. When the risers 5, 6 are successively connected to the tensioning deck 7, the total number of risers connected to the deck varies between 2 and 50 and the weight of each riser, which can have a length of about 1000–3000 meters, varies between 40 and 180 tons, the number of weight elements 12 12', 13, 13'at the end of the pivoting arms 10, 11 is increased.

A blow-out-preventer 16 is supported from the supporting deck 2 for closing of the drilling riser upon a certain pressure increase. Positioning the blow-out-preventer in an accessible location on the supporting deck 2, above water level, facilitates repair and change out of parts.

Figure 2:
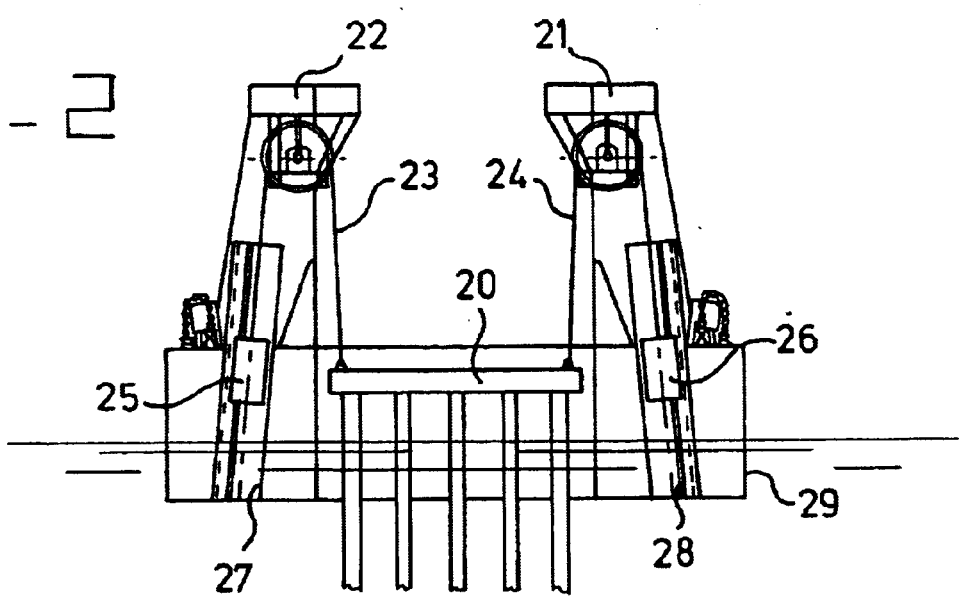
FIGS. 2 and 3 show a side view and a plan view, respectively, of a drilling barge comprising four riser tensioning decks, each deck being suspended from three mounting-arms and from three sets of three cables each.
Figure 3:
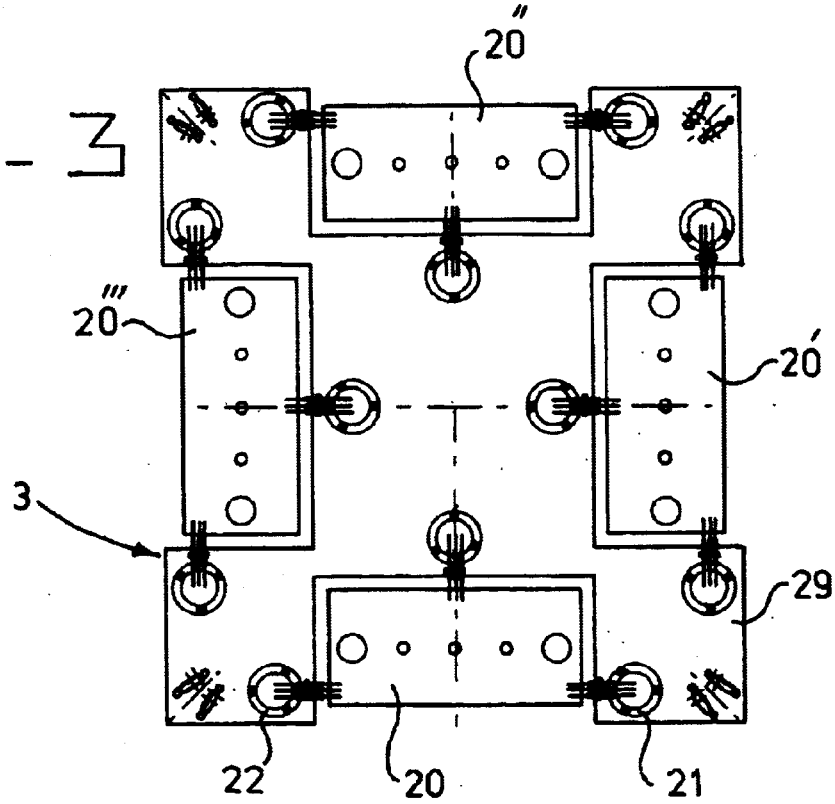

FIG. 2 shows a side view of an embodiment wherein the riser tensioning deck 20 is supported from a suspension member comprising sheaves 21, 22 along which cables 23, 24 are guided. The cables 23, 24 are with one end connected to the riser tensioning deck 20 and with the other end to tensioning weights 25, 26. The weights 25,26 can slide up and down in guide shafts 27, 28. The weights 25, 26 may be provided with rolling guide elements such as wheels, which contact the walls of the guide shafts 27, 28. As can be seen in FIG. 3, the barge 29 comprises four riser tensioning decks 20, 20', 20", 20'". Each deck is suspended from three sheaves 21, 22, 30. Each sheave carries three cables for increased safety.

Figure 4:
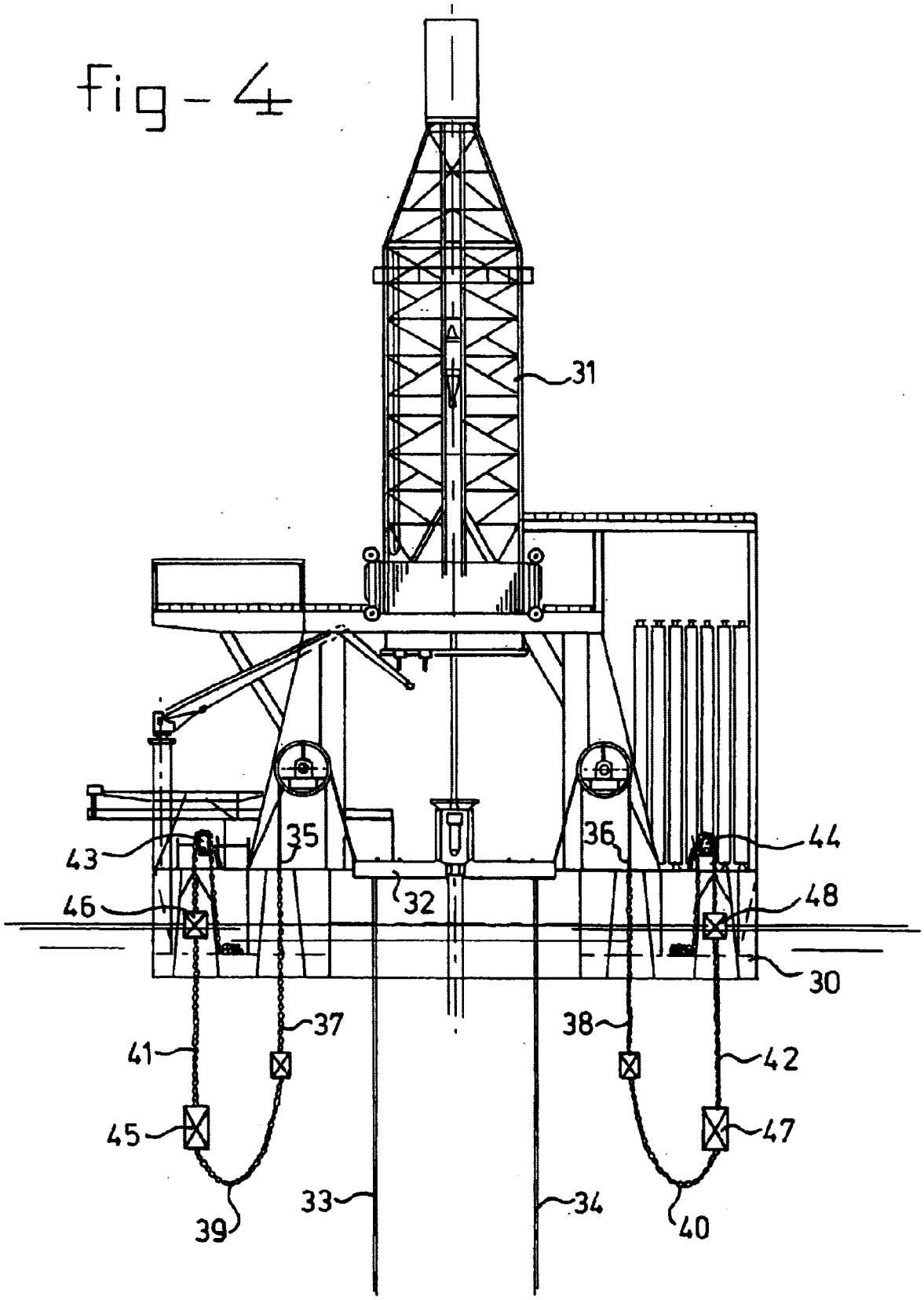
FIG. 4 shows an embodiment wherein a varying tensioning force is exerted by a loop configuration of a cable carrying tensioning weights.

FIG. 4 shows a barge 30 carrying a drilling rig 31 and a riser tensioning deck 32. In figure 4 two risers 33, 34 are connected to the riser tensioning deck 32. The riser tensioning deck 32 is suspended from cables 35, 36. Each cable has a first cable section 37, 38 extending through a well in the barge to below keel level. Each cable 35, 36 comprises a loop 39, 40 and a second cable section 41, 42 extending upwards from the loop 39, 40 through a well in the barge to a pulling device, such as a winch 43, 44. At the position of the winches 43, 44 a chain stopper may be provided. When the length of cable sections 37, 38, 41, 42 is increased, the weight elements 45, 46 and 47, 48 can be lowered and can all be placed on the first cable section 37, 38. In this way, the tensioning force on the riser tensioning deck 32 is increased when more risers are added to the tensioning deck 32 in addition to risers 33, 34. By shortening the first and second cable sections 37, 38 and 41, 42, the weight on the tensioning deck 32 can be decreased as the weights will then be distributed along the second cable sections 41, 42. The weight elements 45, 46, 47, 48 may be combined with flushable buoyancy elements for varying the weight thereof.

Figure 5:
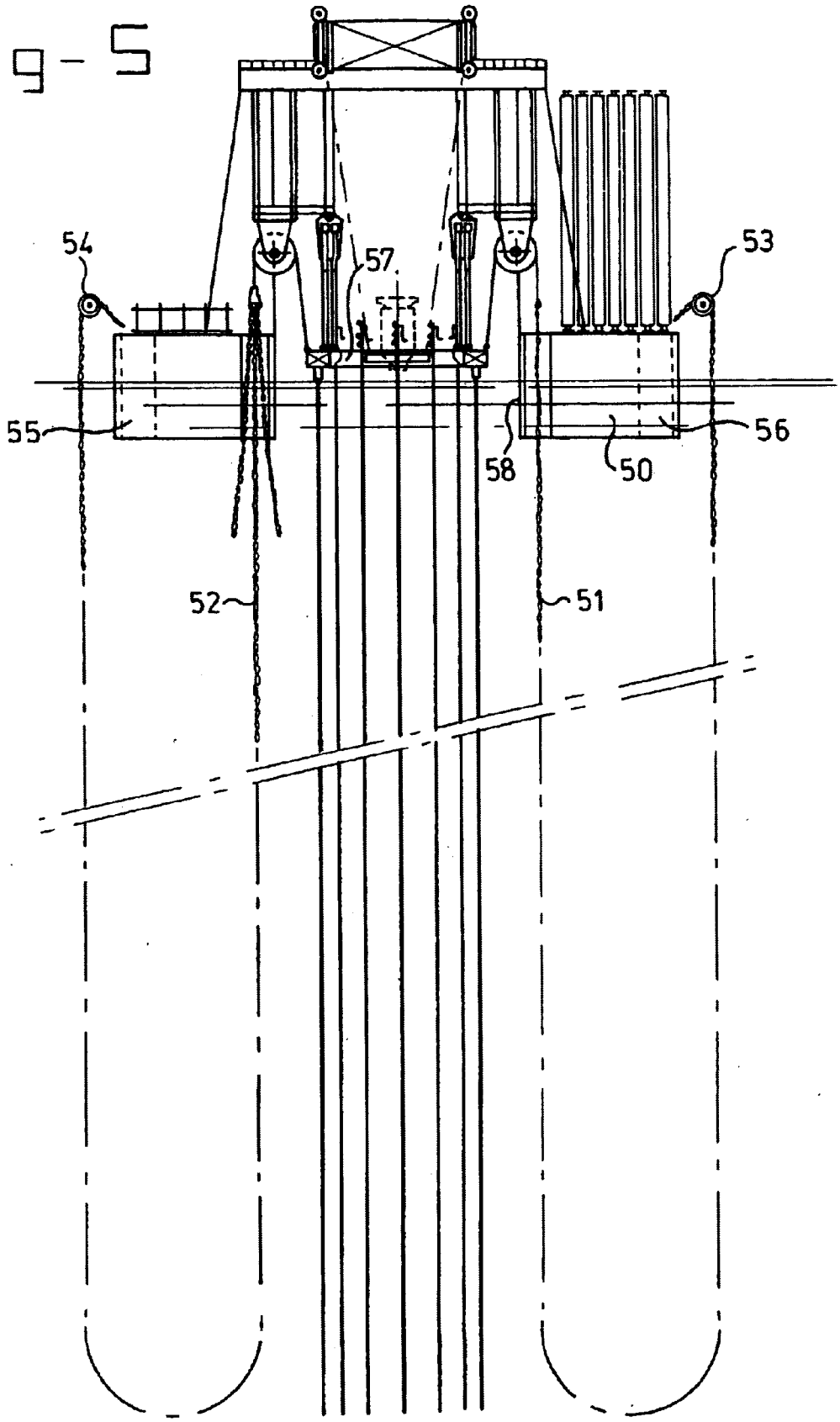
FIGS. 5 and 6 show an embodiment wherein the tensioning weight is formed by a chain section which is placed in a loop configuration, in a side view and a plan view, respectively.

FIG. 5 shows an embodiment of a barge 50 wherein the cables 51, 52 are each comprised of relatively long chains sections with a length of between 100 and 1000 meters. The chains 51, 52 are guided via sheaves 53, 54 projecting beyond the perimeter of the barge 50, and are via a pulling device (not shown in the figure) collected in chain lockers 55, 56.

Figure 6:
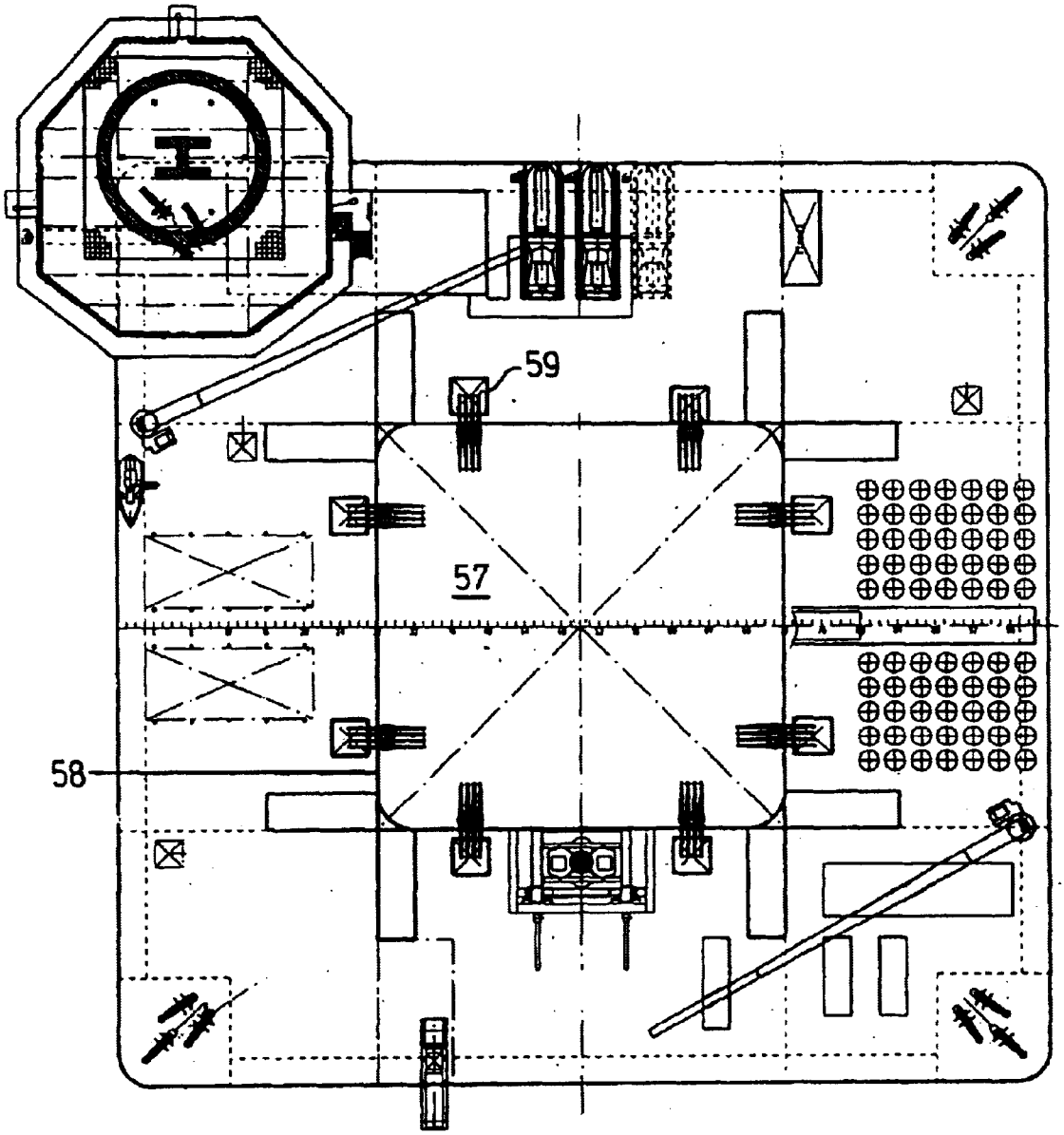

As can be seen from FIG. 6, the riser tensioning, deck 57 is placed over a central well 58 in the vessel and is supported from eight sheave combinations 59.

Figure 7:
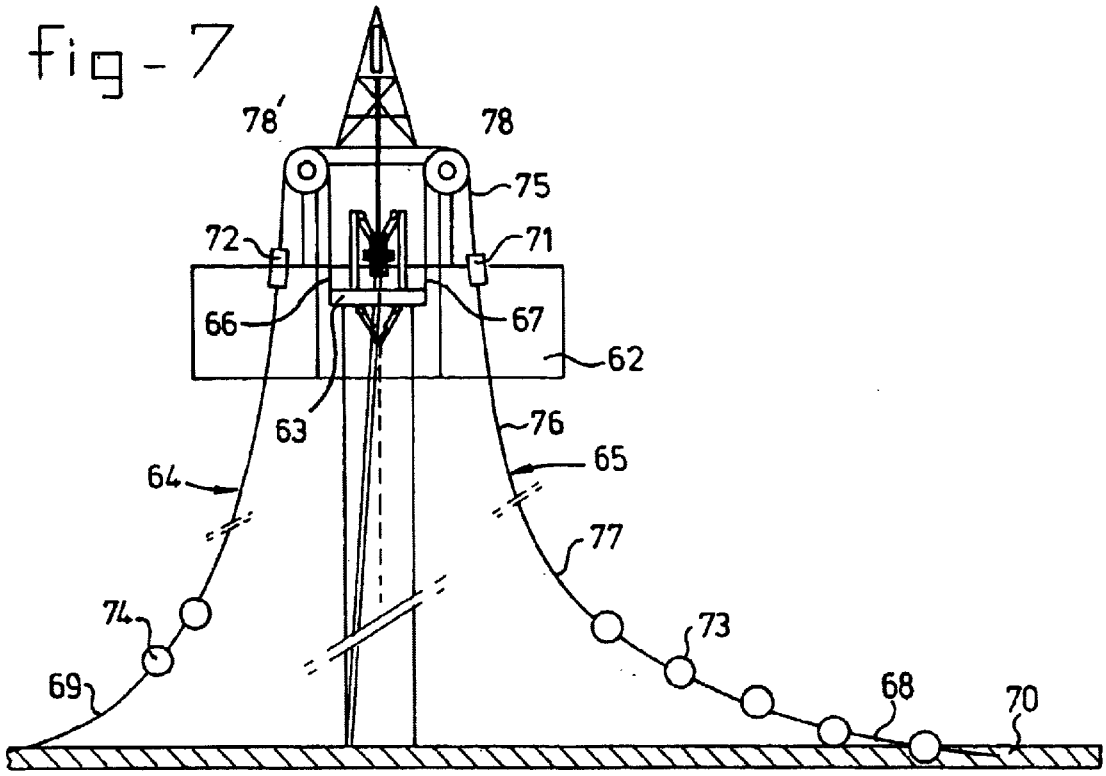
FIG. 7 shows an embodiment wherein the tensioning weight is formed by clump-weights which are lifted from the seabed.

FIG. 7 shows a barge 62 in which the riser tensioning deck 63 is supported from two lines 64, 65. The first ends 66 or 67 of each line are attached to the riser tensioning deck 63, a second end 68, 69 being placed on the seabed 70. Each line 64, 65 is attached to a take-up device 71, 72, such as a winch and chain stopper combination. The tensioning force on the riser tensioning deck 63 can be increased by shortening the lines 64, 65 via the take-up device 71, 72 to lift clump-weights 73, 74, attached to the second ends 68, 69 of the lines 64, 65 from the seabed 70. By paying out the lines 64, 65, the clumpweights 73, 74 will come to rest on the seabed, such that the tension in the lines 64, 65 is decreased. The upper part 75 of the lines 64, 65 may be formed by a steel cable part. The middle section 76, even as the lower ends 68, 69 may be comprised of a chain. An intermediate section 77 may be formed by a cable or polyester mooring line part.

Figure 8:
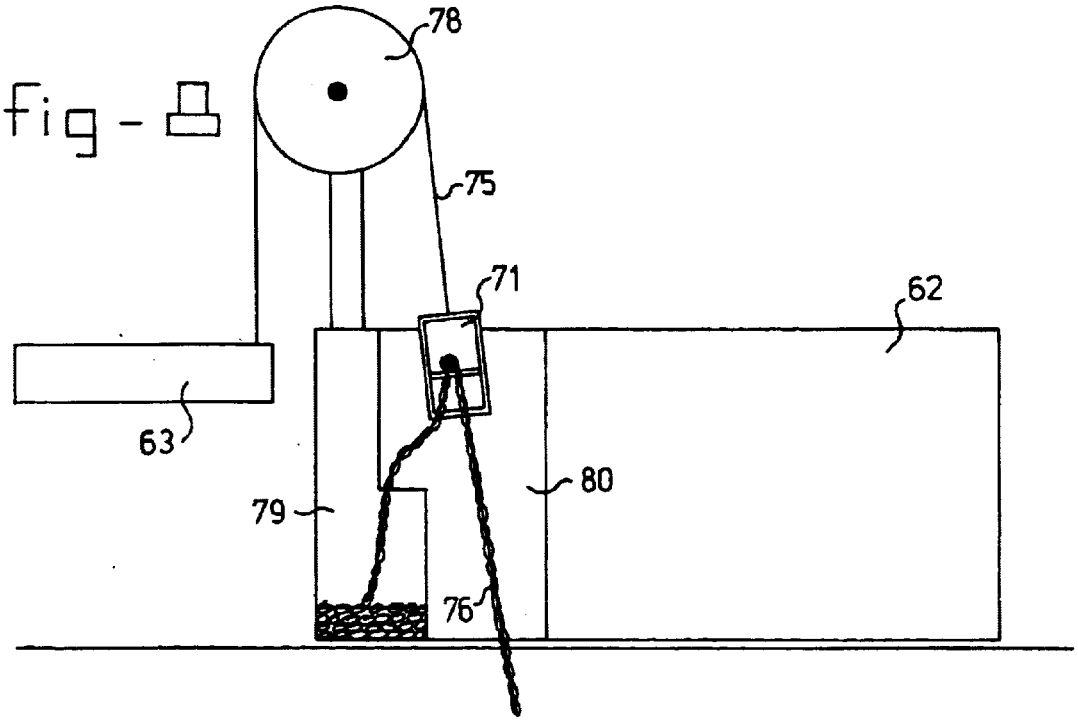
FIG. 8 is a detail of FIG. 7 showing the take up device.
Figure 5:
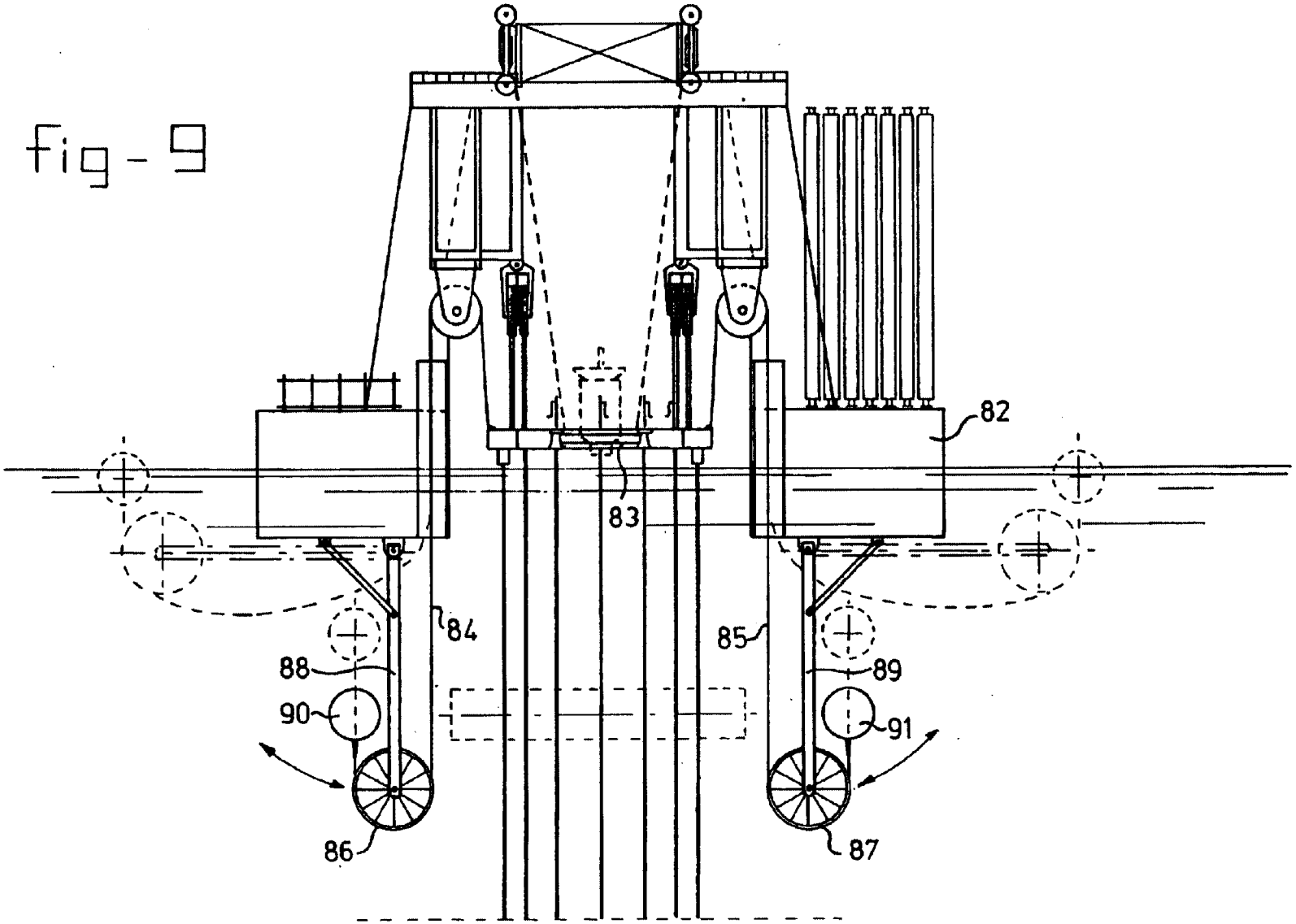

FIG. 8 shows an enlarged detail of a part of the barge 62 of FIG. 7 showing the upper section 75 of line 65 which is guided along a sheave 78, 78' and which is attached to the riser tensioning deck 63. At one end of upper section 75, a chain stopper 71 is connected. By pulling the middle chain section 76 through a well 80 in the barge 62 and through chain stopper 71 and storing it in a chain locker 79, the clump weights 73 are lifted from the seabed 70.

FIG. 9 shows barge 82 wherein the riser tensioning deck 83 is suspended from cables 84, 85. The cables 84, 85 extend along cable guide means 86, 87 at the end of pivot beams 88, 89. Buoyancy tanks 90, 91 are attached to the end of cables 84, 85. Before installation, the pivot beams 88, 89 may be placed into the position which is indicated with the dash and dot lines. When the weight of the risers attached to the deck 83 increases, the pivot beams 88, 89 may be lowered to the position shown in FIG. 9 with the solid lines, for increasing the tension in the cables 84, 85. In an alternative embodiment, the arms 88, 89 are fixed and the buoyancy tanks 90, 91 are ballastable and flushable.

Figure 10:
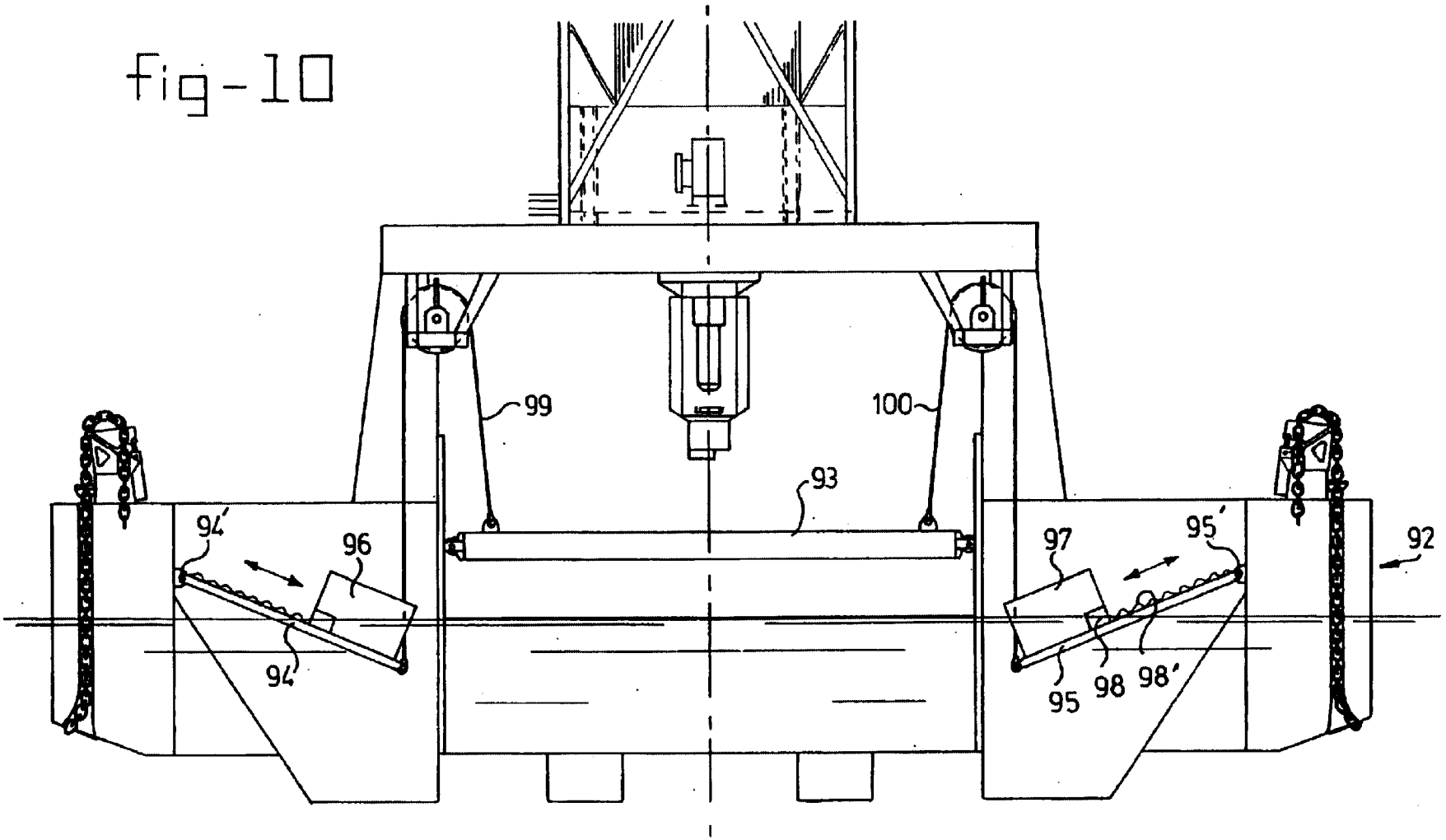
FIG. 10 shows an embodiment wherein the varying tensioning force is exerted by displacement of a counterweight along pivot arms.

FIG. 10 shows an embodiment of a barge 92 wherein the riser tensioning deck 93 is suspended from cables 99, 100 which are attached to the ends of pivot arms 94, 95. The pivot arms 94, 95 are hingeingly connected to the barge 92 via hinges 94', 95'. Counterweights 96, 97 are movable along the arms 94, 95 for instance by a rack 98'and pinion 98 construction for varying the tensioning force on the cables 99, 100.

Figure 11:
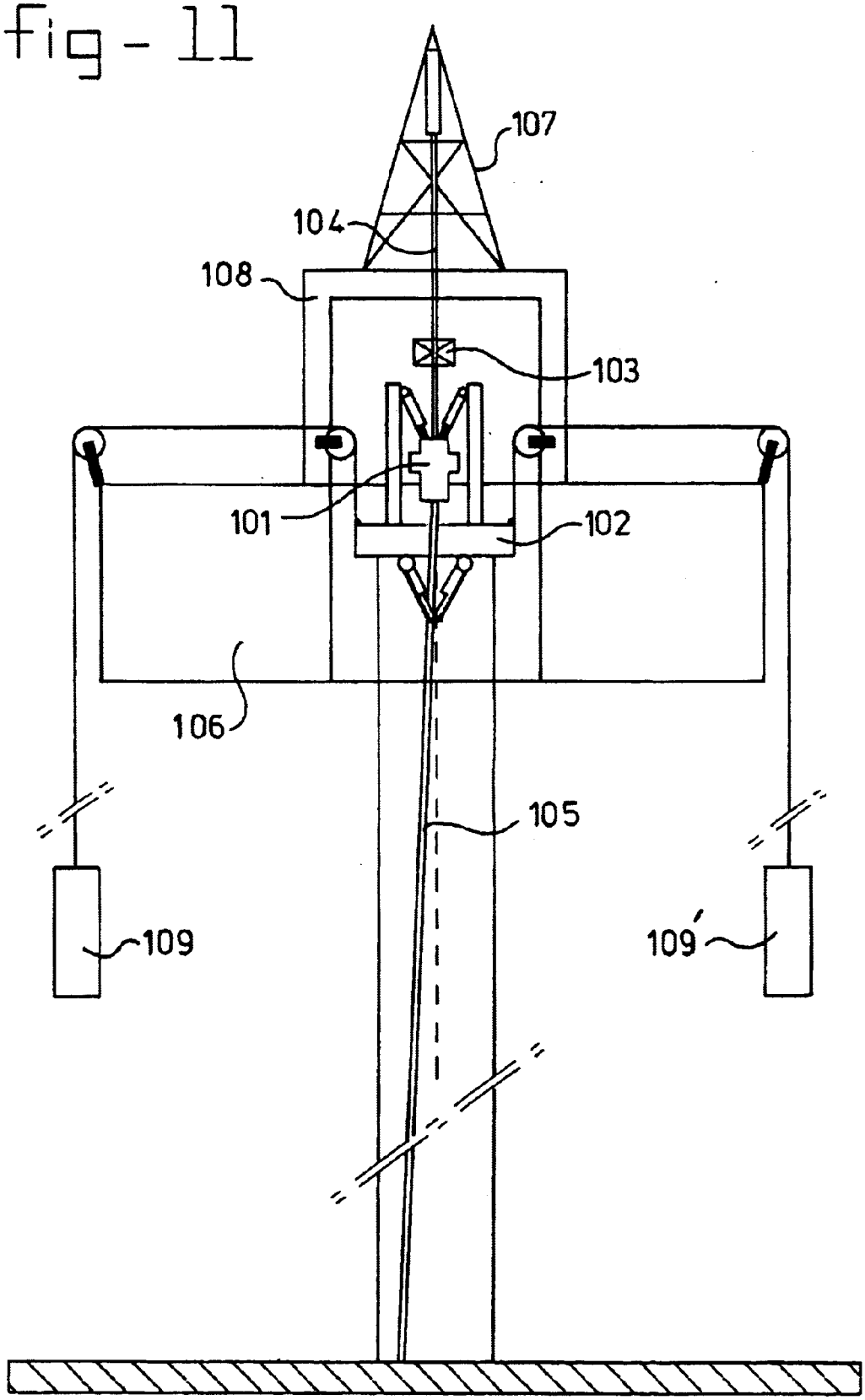
FIG. 11 shows an embodiment wherein a supporting deck is mounted above the connector, carrying a drilling rig, with a disconnectable drill string.

FIG. 11 shows an embodiment of a barge 106 wherein the blow-out preventer 101 is supported on the riser tensioning deck 102. A drilling rig 107 is placed on a supporting deck 108. The riser tensioning deck 102 is suspended from cables which are tensioned by weights 109, 109', which may be ballastable for varying the tensioning force. Via a coupling member, which may be a usual coupling of a drill string segment 103, the drill string 104 may be detached from the drilling rig 107. During stormy conditions, the drill string 104 is detached from the rig 107, while the lower part of the drill string and drilling riser 105 are hung off the inside of the blow out preventer 101. When the sea conditions return to within specific limits, the drill string 104 is reconnected to the drilling rig 107, without the need to dismantle the total drill string and drilling riser (105) and with a minimum down time.

Figure 12:
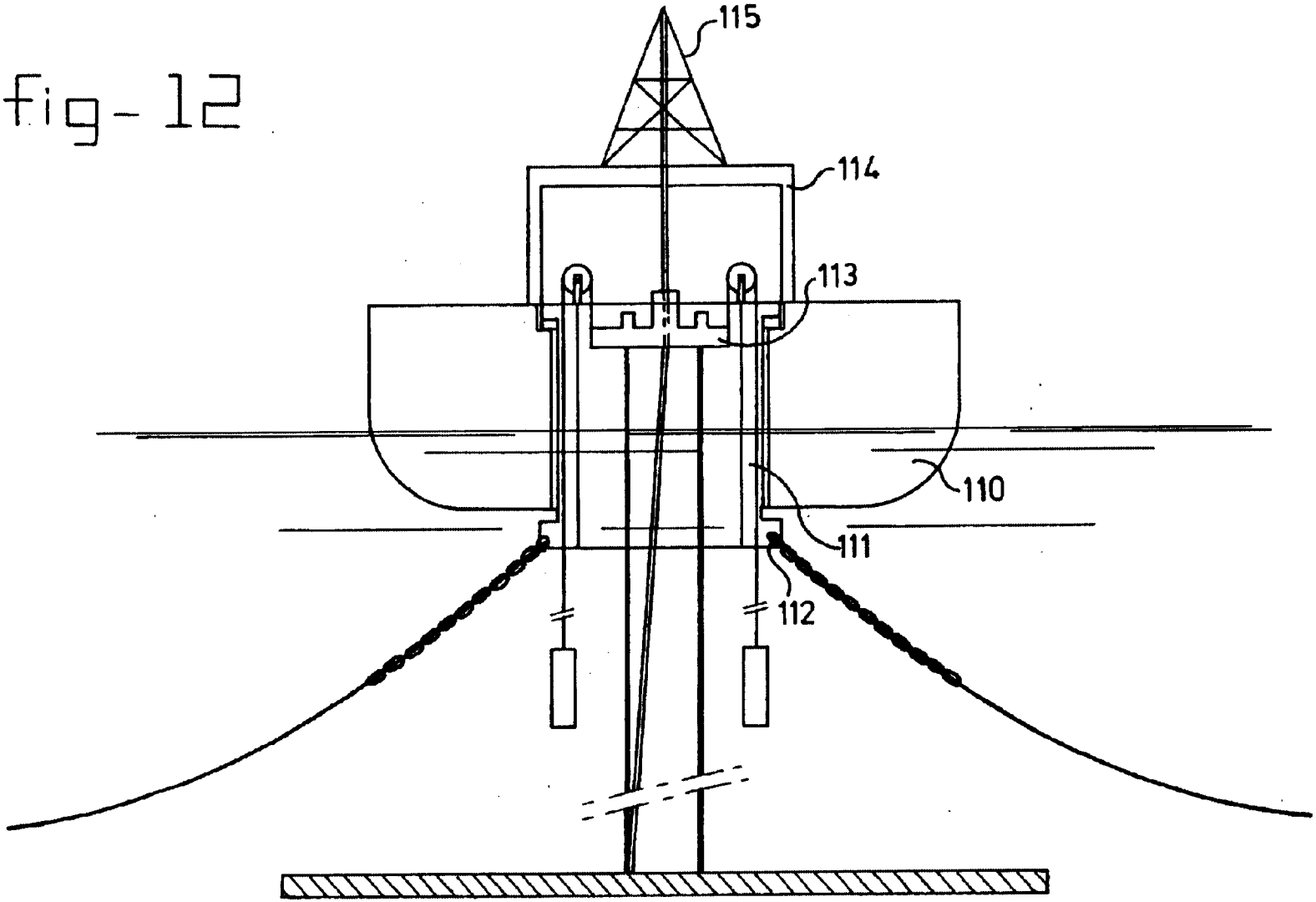
FIG. 12 shows an embodiment of a vessel of the same type as shown in FIG. 11, which is moored to the seabed via a turret having full weathervaning capacities.

FIG. 12 shows a barge 110 which comprises a turret 111 which is anchored to the seabed via a chain table 112. The riser tensioning deck 113 is suspended above or within the turret 111. The supporting deck 114 and drilling rig 115 are connected to the vessel which can weather vane fully around the turret 111. This construction provides full weathervaning and drilling capacities, such that the barge 110 can adjust its position according to prevailing wind and current conditions.

Figure 13:
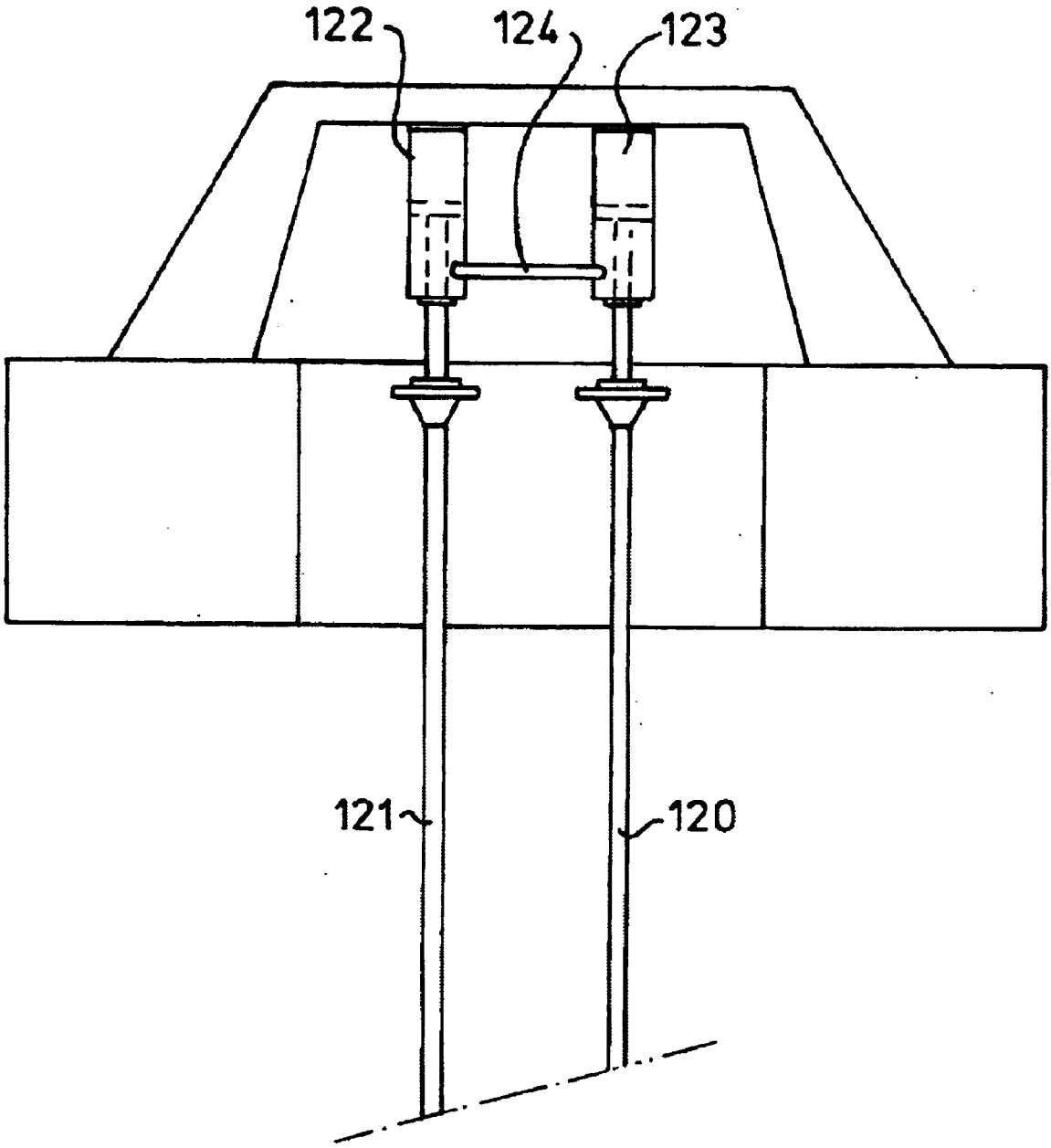
FIG. 13 shows an embodiment comprising hydraulic tensioning means.

FIG. 13 shows an embodiment wherein two risers 120, 121 are suspended from hydraulic cylinders 122, 123, that are connected via a flow line 124. The upward force exerted by the cylinders can be increased by increasing the pressure or by increasing the number of interconnected cylinders. Any of the tensioning methods described above can be used either seperately or in combination with one or more other tensioning methods that are illustrated. Furthermore, active tensioning systems using winches or hydraulic pressure may also be used, either as an alternative to, or in combination with the passive tensioning methods described above.

What is claimed:

1. Vessel comprising:

a connector which is suspended from the vessel by at least two spaced apart suspension members for relative displacement of the connector with respect to the vessel, one or more elongate connection members being attachable with one end to the connector and with the other end to the seabed, each suspension member being connected to tensioning means for exerting an upward force on the connector, wherein a supporting deck is situated above the connector, a first section of a connection member extending from the seabed to the connector, and being detachably connected to a second section of the connection member via a coupling device, said second section being laterally displaceable relative to said first section, the second section being supported by the supporting deck.

2. Vessel according to claim 1, wherein a blow-out-preventor is supported on the connector, the supporting deck carrying a drilling rig.

* * * * *